United States Patent [19]

DeMuro et al.

[11] Patent Number: 4,823,098

[45] Date of Patent: Apr. 18, 1989

[54] MONOLITHIC CERAMIC FILTER WITH BANDSTOP FUNCTION

[75] Inventors: David M. DeMuro, Schaumburg, Ill.; Darioush Agahi-Kesheh, Albuquerque, N. Mex.

[73] Assignee: Motorola, Inc., Schaumburg, Ill.

[21] Appl. No.: 206,384

[22] Filed: Jun. 14, 1988

[51] Int. Cl.[4] ..... H01P 1/202; H01P 1/213

[52] U.S. Cl. ..... 333/206; 333/134; 333/202; 455/78

[58] Field of Search ..... 333/202, 206, 207, 204, 333/205, 222, 223, 219, 219.1, 208–212, 245, 235, 132, 134, 135, 136; 455/78, 82–83

[56] References Cited

U.S. PATENT DOCUMENTS

| | | | |
|---|---|---|---|
| 3,656,162 | 4/1972 | Mee | 343/180 |
| 4,418,324 | 11/1983 | Higgins | 333/204 |
| 4,423,396 | 12/1983 | Makimoto et al. | 333/204 |
| 4,431,977 | 2/1984 | Sokola et al. | 333/206 |
| 4,703,291 | 10/1987 | Nishikawa et al. | 333/202 |
| 4,740,765 | 4/1988 | Ishikawa et al. | 333/202 X |
| 4,742,562 | 5/1988 | Kommrusch | 333/206 |

FOREIGN PATENT DOCUMENTS 0093956 11/1983 European Pat. Off. .

OTHER PUBLICATIONS

Schematic of a Motorola transceiver (interconnection diagram); Motorola No. 41A72-C 7/15/77-UP, publication date of Jul. 15, 1977; 1 page.

"Microwave Filters, Impedance Matching Networks and Coupling Structions", by Matthaei, Young & Jones, Figure 12.07-1 (A Strip-Line Band-Stop Filter with Three Resonators) publication date of 1964; 1 page.

*Primary Examiner*—Marvin L. Nussbaum

*Attorney, Agent, or Firm*—Robert J. Crawford

[57] ABSTRACT

A ceramic filter includes a multiple zero bandstop filter function. The ceramic filter has a dielectric block with top and bottom surfaces and at least two holes, including a first hole and a second hole, extending from the top surface toward the bottom surface of the block. The block is selectively covered with a conductive material to provide a transmission line resonator for each of the two holes. The filter also includes an input electrode coupled to the dielectric means at a predetermined distance from the first hole, and an output electrode coupled to the dielectric means at a predetermined distance from the second hole. Finally, conductive plating, in the form of a transmission line, is contiguously disposed on the dielectric means adjacent the two holes and coupled thereto to provide a bandstop filter function with a zero represented at each hole.

16 Claims, 2 Drawing Sheets

MONOLITHIC CERAMIC FILTER WITH BANDSTOP FUNCTION

FIELD OF THE INVENTION

The present invention relates generally to radio-frequency (RF) signal filters, and, more particularly, to an improved ceramic signal filter that is particularly well adapted for use in radio transmitting and receiving circuitry.

DESCRIPTION OF THE PRIOR ART

Conventional multi-resonator ceramic filters include a plurality of resonators that are typically foreshortened short-circuited quarter wavelength coaxial transmission lines. The resonators are arranged in a conductive enclosure and may be inductively coupled one to another by apertures in their common walls. Each resonator is typically individually tuned to the desired filter response characteristics.

In transmit/receive duplexer applications, two such ceramic filters are commonly used to provide the conventional filtering functions at the antenna interface. Each such ceramic filter typically includes multiple poles, but each is limited to one zero per filter. This zero is situated at the end of the filter that does not interface to another ceramic filter. This limitation arises because a zero at an end of one ceramic filter coupled to another ceramic filter introduces an unacceptable impedance mismatch at their interface. Consequently, stopband attenuation in the flyback region of the filter's response characteristic cannot be increased with additional zeros. Hence, the overall filter design is constrained.

Because of these problems, circulators are commonly used to intercouple the two ceramic filters in such transmit/receive duplexer applications. Circulators typically include a transmitter port for passing RF energy from the transmit filter to an antenna port and a receiver port for passing RF energy from the antenna port to the receive filter. The receiver port is isolated from the transmitter port with respect to the transmitter energy. Unfortunately, circulators are bulky and expensive and they increase the insertion loss of the duplexer. Also, any mismatch at the antenna port will severely degrade the isolation provided by the circulator.

For these reasons, a ceramic filter is needed which overcomes the foregoing deficiencies.

OBJECTS OF THE INVENTION

It is a general object of the present invention to provide a ceramic filter which overcomes the above-mentioned shortcomings.

It is a more particular object of the present invention to provide a ceramic filter which is not limited to one zero for duplexer applications.

It is another object of the present invention to provide a ceramic filter which includes a plurality of zeros adjacent a plurality of poles, the latter of which may be used to interface with a similarly designed filter without requiring a circulator.

BRIEF DESCRIPTION OF THE DRAWINGS

The features of the present invention which are believed to be novel are set forth with particularity in the appended claims. The invention, together with further objects and advantages thereof, may best be understood by making reference to the following description taken together with the accompanying drawings, in which reference numerals identify the elements, and wherein:

DETAILED DESCRIPTION OF THE PREFERRED EMBODIMENT

The arrangement disclosed in this specification has particular use for filtering RF signals in a radio transceiver. More particularly, the arrangement disclosed herein is directed to employing a pair of ceramic filters to implement a duplexer function in a radio transceiver.

Figure 1:
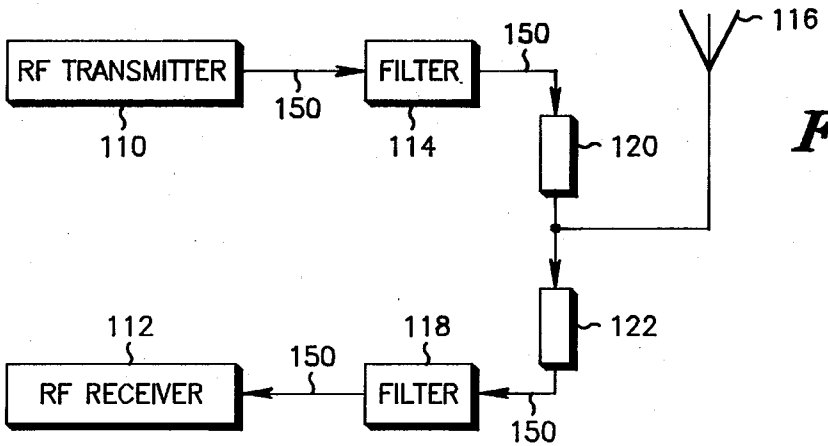
FIG. 1 is a diagram of a RF radio transceiver employing two filters, according to the present invention.

FIG. 1 illustrates such a transceiver. The transceiver includes a conventional RF transmitter 110, and a conventional RF receiver 112. A novel ceramic filter 114, according to the present invention, is used to couple a transmit signal from the RF transmitter 110 to an antenna 116. A similar novel ceramic filter 118 is employed between the antenna 116 and the RF receiver 112 to couple a received FF signal from the antenna 116 to the RF receiver 112. Transmission lines 120 and 122 are respectively disposed between the ceramic filters 114 and 118 and the antenna 116 for proper electrical coupling.

The passband of the filter 114 is centered about the frequency of the transmit signal from RF transmitter 110, while at the same time greatly attenuating the frequency of the received RF signal. In addition, the length of transmission line 120 is selected to maximize its impedance at the frequency of the received signal.

The passband of the filter 118 is centered about the frequency of the received RF signal, while at the same time greatly attenuating the transmit signal. The length of transmission line 122 is selected to maximize its impedance at the transmit signal frequency.

Figure 2:
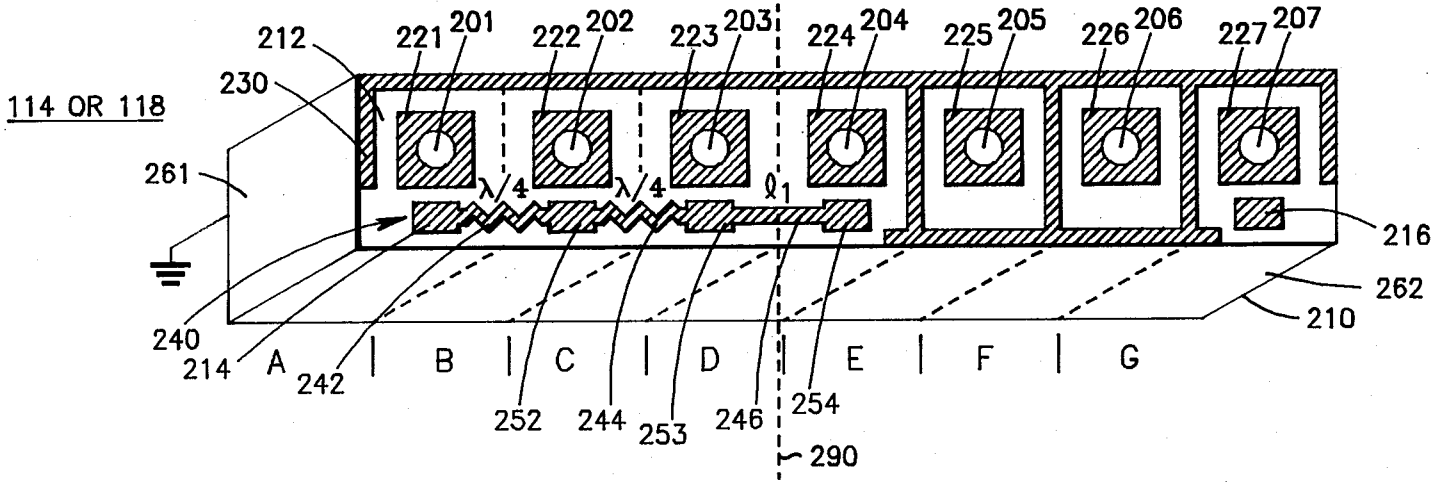
FIG. 2 is an expanded diagram of one of the filters 115 or 119 of FIG. 1, according to the present invention.

In FIG. 2, the filter 114 or 118 is shown in detail, according to the present invention. The filter 114 or 118 includes a block 210 which is comprised of a dielectric material that is selectively plated with a conductive material. The filter 114 or 118 can be constructed of a suitable dielectric material that has low loss, a high dielectric constant and a low temperature coefficient of the dielectric constant. In a preferred embodiment, filter 114 or 118 is comprised of a ceramic compound including barium oxide, titanium oxide and zirconium oxide, the electrical characteristics of which are described in more detail in an article by G. H. Jonker and W. Kwestroo, entitled "The Ternary Systems BzO-$TiO_2$-$SnO_2$ and BaO-$TiO_2$-$ZrO_2$", published in the Journal of the American Ceramic Society, volume 41, number 10, at pages 390–394, October 1958. Of the ceramic compounds described in this article, the compound in Table VI having the composition 18.5 mole % BaO, 77.0 mole % $TiO_2$ and 4.5 mole % $ZrO_2$ and having a dielectric constant of 40 is well suited for use in the ceramic filter of the present invention.

The plating on block 210 is electrically conductive, preferably copper, silver or an alloy thereof. Such plating preferably covers all surfaces of the block 210 with the exception of the top surface 212, the plating of which is discussed below. Of course, other conductive plating arrangements can be utilized. See, for example, those discussed in "Ceramic Bandpass Filter", U.S. Pat. No. 4,431,977, Sokola et al., assignee to the present assignee and incorporated herein by reference.

Block 210 includes seven holes 201–207, which of each extend from the top surface to the bottom surface thereof. The surfaces defining holes 201–207 are likewise plated with an electrically conductive material, depicted by the unshaded area within the respective hole 201–207. Each of the plated holes 201–207 is essentially a transmission line resonator comprised of a short-circuited coaxial transmission line having a length selected for desired filter response characteristics. For additional description of the holes 201–207, reference may be made to U.S. Pat. No. 4,431,977, Sokola et al., supra.

Block 210 in FIG. 1 also includes input and output electrodes 214 and 216 for receiving an RF signal and for passing a filtered RF signal, respectively. Although block 210 is shown with seven plated holes 201–207, any number of plated holes can be utilized depending on the filter response characteristics desired. RF signals can be coupled to the electrodes 214 and 216 of the filter 114 or 118 by conventional circuits (depicted generally as 150) such as those discussed in U.S. Pat. No. 4,431,977, Sokola et al., supra.

Coupling between the transmission line resonators, provided by the plated holes 201–207, in FIG. 2 is accomplished through the dielectric material and is varied by varying the width of the dielectric material and the distance between adjacent transmission line resonators. The width of the dielectric material between adjacent holes 201–207 can be adjusted in any suitable regular or irregular manner, such as, for example, by the use of slots, cylindrical holes, square or rectangular holes, or irregular shaped holes.

Furthermore, plated or unplated holes located between the transmission line resonators, provided by holes 201–207, can also be utilized for adjusting the coupling.

According to the present invention, a top surface 212 of the block 210 is selectively plated with a similar electrically conductive material, illustrated by the shaded areas on the top surface 212. The selective plating includes portions of plating 221–227, preferably rectangular shape, surrounding each hole 201–207, respectively. The plating 221–227 is used to couple the transmission line resonators, provided by the holes 201–207, to ground plating 230 on the top surface of the block 210, and also to transmission line plating 240, provided adjacent to plating 221–224.

The transmission line plating 240 includes the previously discussed electrode 214 as well as transmission line sections 242, 244 and 246, and electrodes 252, 253 and 254.

The transmission line plating 240 on the top surface of block 210 of FIG. 2, in accordance with the present invention, distinguishes the function of one portion of the block 210 from another portion. In FIG. 2, block 210 is divided into seven sections by dotted lines, depicted A–G. The transmission line plating 240 separates sections A–C from sections D–G. Sections A–C of the block 210 function as a 3-pole bandstop filter, while sections D–G function as a 4-pole bandpass filter. In accordance with the present invention, electrode 214, transmission line section 242, electrode 252, transmission line section 244 and electrode 253 provide transmission line coupling between their respective transmission line resonators, in each section A–C, to enable such resonators to individually provide a zero to the filter 114 or 118. The transmission line sections 242 and 244 are preferably designed to be a quarter wavelength at the notch frequency. For this reason, transmission line sections 242 and 244 are depicted in a non-linear manner.

The transmission line section 242 is designed at a quarter wavelength act as an impedance inverter (transformer) for an RF signal passing from the transmission line resonator in section A of block 210 to the transmission line resonator in section B of block 210. Similarly, while the transmission line section 244, also at a quarter wavelength, acts as an impedance inverter for the RF signal passing from the transmission line resonator in section B of block 210 to the transmission line resonator in section C of block 210. The transmission line section 246, of length 11 is unrelated to the quarter wavelength functions of sections 242 and 244, and acts to couple the RF signal in the bandstop section of the block 210 (sections A–C) to the bandpass section of the block 210 (sections D–G).

Figure 3:
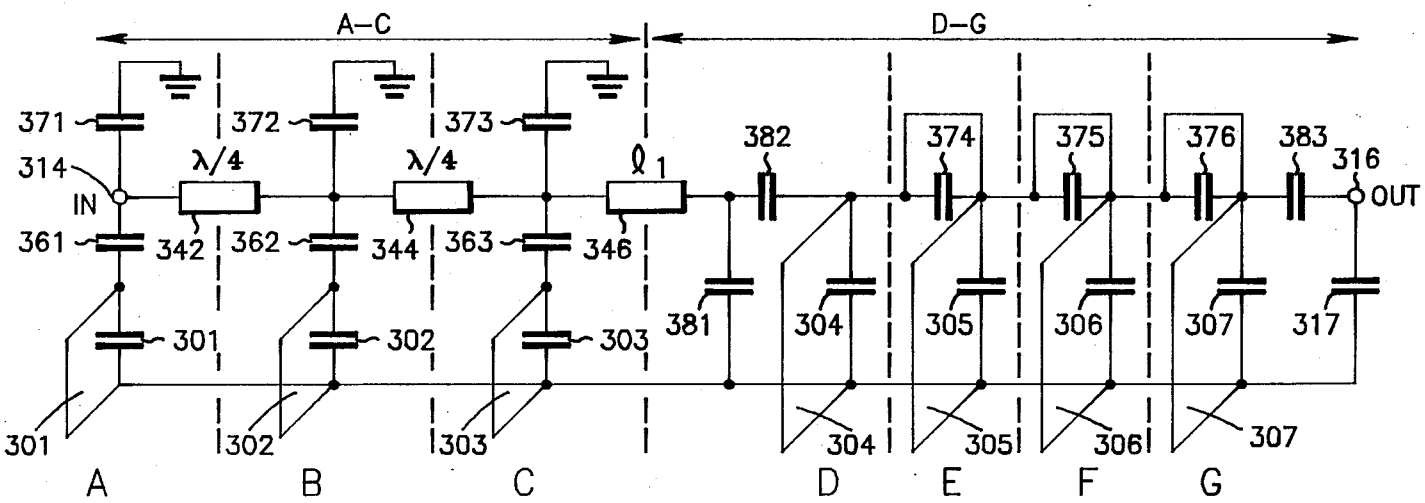
FIG. 3 is a circuit model of the filter illustrated in FIG. 2, according to the present invention.

Referring now to FIG. 3, there is shown an equivalent circuit diagram, less parasitic couplings and capacitances, for the filter 114 or 118 of FIG. 2. The circuit of FIG. 3 includes an input port 314 which corresponds to the input electrode 214 of FIG. 2, and an output port 316 which corresponds to the output electrode 216 of FIG. 2. Similarly, a capacitor 317 of FIG. 3 corresponds to capacitance between the output electrode 216 and the plated sidewall 262 of block 210. Transmission line sections 242, 244 and 246 of FIG. 2 are represented in FIG. 3 by transmission line sections 342, 344 and 346, respectively. The coaxial resonators provided by the plated holes 201–207 of FIG. 2 is represented by the short circuited capacitance arrangements 301–307, respectively, of FIG. 3. Capacitors 361, 362 and 363 of FIG. 3 corresponds to capacitance between the plated portions 221, 222 and 223 and their associated electrodes 214, 252 and 253, respectively. Capacitors 371, 372 and 373 of FIG. 3 correspond to the respective capacitance between the electrodes 214, 252 and 253 and the plated sidewall 262 of block 210.

Focusing now on sections D–G of the block 210, capacitor 381 of FIG. 3 corresponds to capacitance between electrode 254 and the plated sidewall 262 of block 210 of FIG. 2, while capacitor 382 corresponds to capacitance between electrode 254 and the transmission line resonator provided by the plated hole 204. Capacitor 383 of FIG. 3 corresponds to capacitance between the output electrode 216 and the transmission line resonator provided by hole 207 of FIG. 2.

The short circuited transmission lines 390, 391, and 392 represent the magnetic coupling within the block of 210 between each pair of contiguous transmission line resonators. The capacitors 374, 375 and 376 represent the capacitive coupling between the transmission line resonators in the block 210 as caused by the plated portions 225, 226 and 227. The ground plating 230 between the plated portions 225, 226 and 227 controls the value of the capacitance, therebetween. As the width of the ground plating 230 therebetween is increased, such capacitance lessens. Likewise, as the width of the ground plating 230 therebetween is lessened, the capacitance between the transmission line resonators is increased.

In accordance with the present invention, the structure shown in FIG. 2 provides significant advantages over the prior art previously discussed. This structure of FIG. 2 provides a bandstop filter function along with a bandpass filter function in the same coaxial ceramic filter. The bandstop filter function, as represented by the 3-zeros provided by transmission line resonators in sections A, B and C of block 210, provide a substantially increased level of stopband attenuation in the flyback region of the filter response characteristics. Not only does this substantially increase the filter's selectivity, it enables two such filters to be directly intercoupled without using a circulator. This intercoupling can be implemented using the nonzero end of the filter to intercoupling the two filters, thus providing for the previously discussed RF transceiver duplexer function, In FIG. 2, a dashed vertical line 290 is depicted to indicate that the sections A, B and C of the block 210 can operate as an independent filter. To implement such an independent filter, block 210 is truncated at the dotted line 290, the new sidewall caused by the truncation is conductively plated as are the other sidewalls, the transmission line section 246 is removed and the electrode 253 acts as the output electrode. In this manner, the ceramic filter of FIG. 2 acts as an independent multiple zero bandstop filter.

Tuning the various capacitances depicted in FIG. 2 and illustrated in FIG. 3 can be accomplished by changing the amount of plating 221–227 or 230 on the top surface 212 of the block 210. For example, the plating portion 221 of FIG. 2 can be trimmed to decrease the value of capacitor 371 of FIG. 3. Alternatively, the value of capacitor 371 can be altered by adding or trimming the ground plating 230 adjacent the plating portion 221.

Figure 4:
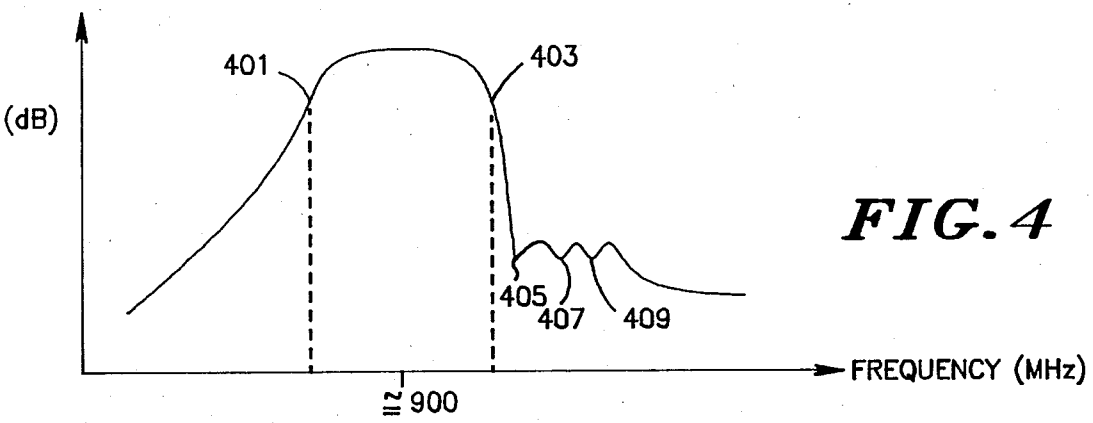
FIG. 4 is a diagram illustrating the response characteristics of a preferred embodiment of one of the filters 115 or 119 as illustrated and described with FIG. 2.

Referring now to FIG. 4, there is shown a diagram illustrating filter response characteristics for a preferred embodiment of a filter designed as illustrated by FIG. 2. On a vertical axis, the through-transmission signal strength is shown in decibels. On the horizontal axis, the frequency is depicted in megahertz. As the diagram in FIG. 4 illustrates, the overall function of the filter is of a passband nature centered at approximately 900 MHz. The passing of frequencies between points 401 and 403 in FIG. 4 is provided by the passband function of the filter in FIG. 2. Specifically, sections D–G of block 210 in FIG. 2 provide this passing function. Sections A–C of block 210 in FIG. 2, each providing a zero in the filter response characteristics, represent the notches 405, 407 and 409 in the diagram of FIG. 4.

It will be understood by those skilled in the art that various modifications and changes may be made to the present invention without departing from the spirit and scope thereof.

What is claimed is:

1. A filter comprising:

dielectric means comprised of a dielectric material having top and bottom surfaces, said dielectric means further having at least two holes, including a first hole and a second hole with no intervening holes therebetween, extending from the top surface toward the bottom surface thereof and spatially disposed at a predetermined distance from one another, said dielectric means selectively covered with a conductive material to provide a transmission line resonator for each of said at least two holes;

input electrode means comprised of a conductive material coupled to the dielectric means at a predetermined distance from said first hole in dielectric means;

output electrode means comprised of a conductive material coupled to the dielectric means at a predetermined distance from said second hole in the dielectric means; and plating line means comprised of a conductive material contiguously disposed on the dielectric means adjacent said first hole and said second hole and coupled thereto to provide a bandstop filter function.

2. A filter, according to claim 1, wherein said at least two holes include a surface covered with conductive plating.

3. A filter, according to claim 1, wherein said dielectric means includes portions of conductive plating surrounding said at least two holes.

4. A filter, according to claim 3, wherein said plating line means is disposed a predetermined distances from said portions of conductive plating.

5. A filter, according to claim 1, wherein said input electrode means is part of said plating line means.

6. A filter, according to claim 1, wherein said output electrode means is part of said plating line means.

7. A filter, according to claim 1, wherein said plating line means includes at least one impedance inverter means.

8. A filter, according to claim 1, wherein said plating line means includes at least one quarter wavelength transmission line.

9. A filter comprising:

dielectric means comprised of a dielectric material having top and bottom surfaces, said dielectric means further having at least three holes extending from the top surface toward the bottom surface thereof, said three holes including:

a first hole and a second hole wherein the first hole is spatially disposed at a predetermined distance from the second hole without any intervening holes therebetween, and a third hole spatially disposed at a predetermined distance from the second hole; conductive material selectively covering said dielectric means to provide a transmission line resonator for each of said at least three holes;

electrode means comprised of a conductive material coupled to the dielectric means at a predetermined distance from said first hole of said first, second and third holes;

electrode means comprised of a conductive material coupled to the dielectric means at a predetermined distance from said third hole of said first, second and third holes; and impedance inverter plating means comprised of a conductive material contiguously disposed on the dielectric means adjacent said first hole and said second hole and coupled thereto to provide a bandstop filter function.

10. A filter, according to claim 9, wherein said impedance inverter plating means includes at least on quarter wave length transmission line.

11. A filter, according to claim 10, wherein said quarter wave length transmission line includes a non-lineal conductive plating segment.

12. A filter, according to claim 9, wherein said third hole provides a bandpass filter function within the filter.

13. An RF transceiver comprising:

a transmitter;
a receiver;
an antenna;
first filter means coupled between said transmitter and said antenna;
second filter means coupled between said receiver and said antenna;
at least one of said first filter means and said second filter means including:
dielectric means comprised of a dielectric material having top and bottom surfaces, said dielectric means further having at least two holes, including a first hole and a second hole with no intervening holes therebetween, extending from the top surface toward the bottom surface thereof and spatially disposed at a predetermined distance from one another, said dielectric means selectively covered with a conductive material to provide a transmission line resonator for each of said at least two holes,
input electrode means comprised of a conductive material coupled to the dielectric means at a predetermined distance from said first hole in the dielectric means,
output electrode means comprised of a conductive material coupled to the dielectric means at a predetermined distance from said second hole in the dielectric means, and
plating line means comprised of a conductive material contiguously disposed on the dielectric means adjacent said first hole and said second hole and coupled thereto to provide a bandstop filter function.

14. A duplexer for coupling a transceiver to an antenna, comprising:
first filter means, having an input stage coupled to the antenna and an output stage coupled to the transceiver, for selecting signals applied thereto; said first filter means further comprising:
dielectric means comprised of a dielectric material having top and bottom surfaces, said dielectric means further having at least two holes, including a first hole and a second hole with no intervening holes therebetween, extending from the top surface toward the bottom surface thereof and spatially disposed at a predetermined distance from one another, said dielectric means selectively covered with a conductive material to provide a transmission line resonator for each of said at least two holes;
input electrode means comprised of a conductive material coupled to the dielectric means at a predetermined distance from said first hole in dielectric means;
output electrode means comprised of a conductive material coupled to the dielectric means at a predetermined distance from said second hole in the dielectric means; and
plating line means comprised of a conductive material contiguously disposed on the dielectric means adjacent said first hole and said second hole and coupled thereto to provide a bandstop filter function; and
second filter means, having an input stage coupled to the transceiver and an output stage coupled to the antenna, for selecting signals applied thereto.

15. A duplexer for coupling a transceiver to an antenna, comprising:
first filter means, having an input stage coupled to the antenna and an output stage coupled to the transceiver, for selecting signals applied thereto; and
second filter means, having an input stage coupled to the transceiver and an output stage coupled to the antenna, for selecting signals applied thereto; said first filter means further comprising:
dielectric means comprised of a dielectric material having top and bottom surfaces, said dielectric means further having at least two holes, including a first hole and a second hole with no intervening holes therebetween, extending from the top surface toward the bottom surface thereof and spatially disposed at a predetermined distance from one another, said dielectric means selectively covered with a conductive material to provide a transmission line resonator for each of said at least two holes;
input electrode means comprised of a conductive material coupled to the dielectric means at a predetermined distance from said first hole in dielectric means;
output electrode means comprised of a conductive material coupled to the dielectric means at a predetermined distance from said second hole in the dielectric means; and
plating line means comprised of a conductive material contiguously disposed on the dielectric means adjacent said first hole and said second hole and coupled thereto to provide a bandstop filter function.

16. A bandstop filter comprising:
dielectric means comprised of a dielectric material having top and bottom surfaces, said dielectric means further having at least two holes, including a first hole and a second hole with no intervening holes therebetween, extending from the top surface toward the bottom surface thereof and spatially disposed at a predetermined distance from one another, said dielectric means selectively covered with a conductive material to provide a transmission line resonator for each of said at least two holes;
input electrode means comprised of a conductive material coupled to the dielectric means at a predetermined distance from said first hole in dielectric means;
output electrode means comprised of a conductive material coupled to the dielectric means at a predetermined distance from said second hole in the dielectric means; and
plating line means comprised of a conductive material contiguously disposed on the dielectric means adjacent said first hole and said second hole and coupled thereto to provide a bandstop filter function.

* * * * *

UNITED STATES PATENT AND TRADEMARK OFFICE

CERTIFICATE OF CORRECTION

PATENT NO. : 4,823,098

DATED : April 18, 1989

INVENTOR(S) : Demuro, David M. and Agahi-Kesheh, D.

It is certified that error appears in the above-identified patent and that said Letters Patent is hereby corrected as shown below:

In Column 6, line 61 please correct "on" to --one--.

Signed and Sealed this

Thirtieth Day of January, 1990

*Attest:*

JEFFREY M. SAMUELS

*Attesting Officer*

*Acting Commissioner of Patents and Trademarks*